US006755356B1

(12) United States Patent
Bergquist

(10) Patent No.: US 6,755,356 B1
(45) Date of Patent: Jun. 29, 2004

(54) LAWN SPRINKLER SAFETY CAP

(76) Inventor: Shirley Bergquist, 2419 Ginger Ct., West Covina, CA (US) 91792

( * ) Notice: Subject to any disclaimer, the term of this patent is extended or adjusted under 35 U.S.C. 154(b) by 0 days.

(21) Appl. No.: 10/295,420

(22) Filed: Nov. 15, 2002

Related U.S. Application Data

(60) Provisional application No. 60/348,351, filed on Jan. 16, 2002.

(51) Int. Cl.[7] ..... B05B 1/28

(52) U.S. Cl. ..... 239/288.5; 239/201; 239/203; 239/288.3

(58) Field of Search ..... 239/201, 203, 239/200, 288, 288.3, 288.5

(56) References Cited

U.S. PATENT DOCUMENTS

| | | | | |
|---|---|---|---|---|
| 3,015,448 A | * | 1/1962 | Hurless | 239/201 |
| 3,265,310 A | | 8/1966 | Cohen | |
| 3,514,040 A | | 5/1970 | Carson | |
| 4,582,256 A | | 4/1986 | Jaquez | |
| 4,781,327 A | * | 11/1988 | Lawson et al. | 239/203 |
| 5,211,338 A | * | 5/1993 | Leite et al. | 239/288.5 |
| 5,222,669 A | | 6/1993 | Lawson | |
| 5,918,814 A | * | 7/1999 | Hough | 239/288 |
| 5,931,385 A | * | 8/1999 | Miller | 239/288 |
| 5,938,121 A | * | 8/1999 | Ferguson et al. | 239/203 |
| 6,494,386 B1 | * | 12/2002 | Banu | 239/288 |

* cited by examiner

*Primary Examiner*—Steven J. Ganey
(74) *Attorney, Agent, or Firm*—Matthew J. Peirce

(57) ABSTRACT

An apparatus to be used with lawn sprinkler systems is disclosed. The apparatus would be a protective cap for brass lawn sprinkler heads and would be available in a few different variations. One variation would be removable, while the other variation would be fixed in place and would have a hinged lid that would allow the brass lawn sprinkler head to poke through when watering a lawn.

2 Claims, 1 Drawing Sheet

LAWN SPRINKLER SAFETY CAP

Priority is hereby claimed to application No. 60/348,351, filed on Jan. 16, 2002.

I. BACKGROUND OF THE INVENTION

The present invention concerns that of a new and improved apparatus to be used with lawn sprinkler systems.

II. DESCRIPTION OF THE PRIOR ART

U.S. Pat. No. 5,222,669, issued to Lawson, discloses a pop-up sprinkler capable of retracting and being protected by a cover when not in use.

U.S. Pat. No. 4,582,256, issued to Jaquez, discloses a protector for a sprinkler head with a two-piece cover assembly capable of closing to prevent damage while not in use.

U.S. Pat. No. 3,514,040, issued to Carson, discloses a sprinkler cage.

U.S. Pat. No. 3,265,310, issued to Cohen, discloses a sprinkler head protective device comprised of a hooded portion for shielding the device during non-use.

III. SUMMARY OF THE INVENTION

The present invention concerns that of a new and improved apparatus to be used with lawn sprinkler systems. The apparatus would be a protective cap for brass lawn sprinkler heads and would be available in a few different variations. One variation would be removable, while the other variation would be fixed in place and would have a hinged lid that would allow the brass lawn sprinkler head to poke through when watering a lawn.

There has thus been outlined, rather broadly, the more important features of a protective cap for brass lawn sprinkler heads so that the detailed description thereof that follows may be better understood and in order that the present contribution to the art may be better appreciated. There are, of course, additional features of a protective cap for brass lawn sprinkler heads that will be described hereinafter and which will form the subject matter of the claims appended hereto.

In this respect, before explaining at least one embodiment of the protective cap for brass lawn sprinkler heads in detail, it is to be understood that the protective cap for brass lawn sprinkler heads is not limited in its application to the details of construction and to the arrangements of the components set forth in the following description or illustrated in the drawings. The protective cap for brass lawn sprinkler heads is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present protective cap for brass lawn sprinkler heads. It is important, therefore, that the claims be regarded as including such equivalent constructions insofar as they do not depart from the spirit and scope of the present invention.

It is therefore an object of the present invention to provide a protective cap for brass lawn sprinkler heads which has all of the advantages of the prior art and none of the disadvantages.

It is another object of the present invention to provide a protective cap for brass lawn sprinkler heads which may be easily and efficiently manufactured and marketed.

It is another object of the present invention to provide a protective cap for brass lawn sprinkler heads which is of durable and reliable construction.

It is yet another object of the present invention to provide a protective cap for brass lawn sprinkler heads which is economically affordable and available for the relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
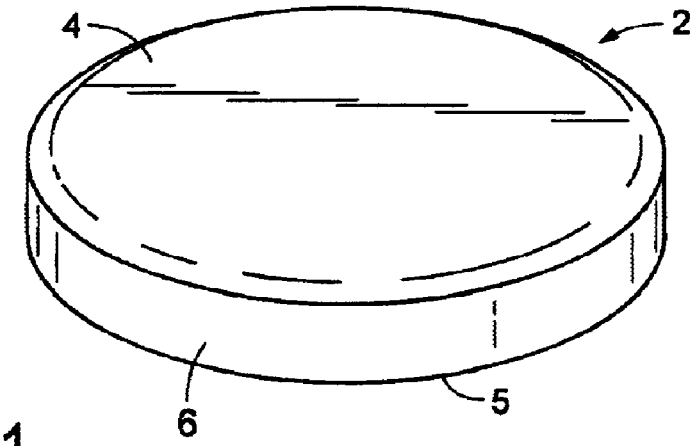
FIG. 1 shows a perspective view of a solid lid cap.

FIG. 1 shows a perspective view of a solid lid cap 2. The solid lid cap 2 would ideally be used as a temporary measure to cover brass lawn sprinkler heads on lawns to prevent children from injuring their face or limbs should they fall when playing. Presently, brass lawn sprinkler heads present problems, especially when injuries occur while these brass lawn sprinkler heads are on public property.

In use, solid lid cap 2 would be used to cover brass lawn sprinkler heads while children would be playing and could be removed after play. Ideally, solid lid cap 2 would be loosely placed directly over each brass sprinkler head, so that if a person forgets to remove one or more solid lid caps 2, then they will automatically be shot off when the brass sprinkler head comes up for watering and/or water begins to emit from the relevant brass sprinkler heads.

Solid lid cap 2 would have be a disc that would have two sides, a top side 4 and a bottom side 5. The top side 4 and bottom side 5 would each be flat. A continuous side edge 6 would be attached to the bottom side 5 of the solid lid cap 2 around the perimeter of the cap 2. The point at which the continuous side edge 6 would connect with the bottom side 5 of the cap 2 would be rounded so as to minimize injuries if a user fell on top of solid lid cap 2.

Figure 2:
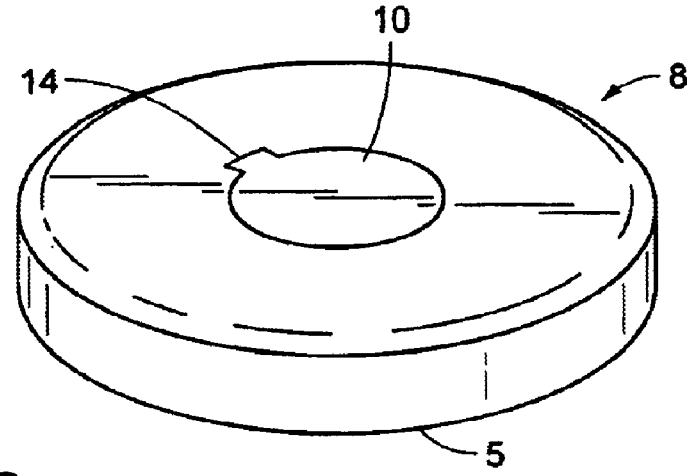
FIG. 2 shows a perspective view of a permanent cap with a hinged lid, with the hinged lid being closed.

FIG. 2 shows a perspective view of a permanent cap 8 with a hinged lid 10, with the hinged lid being closed. In this version of the present invention, permanent cap 8 would be fixedly attached over each brass lawn sprinkler head. Hinged lid 10 would be pivotally attached to permanent cap 8 and would have a spring-activated lever 14 keeping hinged lid 10 in a closed position when the brass lawn sprinkler head underneath permanent cap 8 would not be in an upright position.

Figure 3:
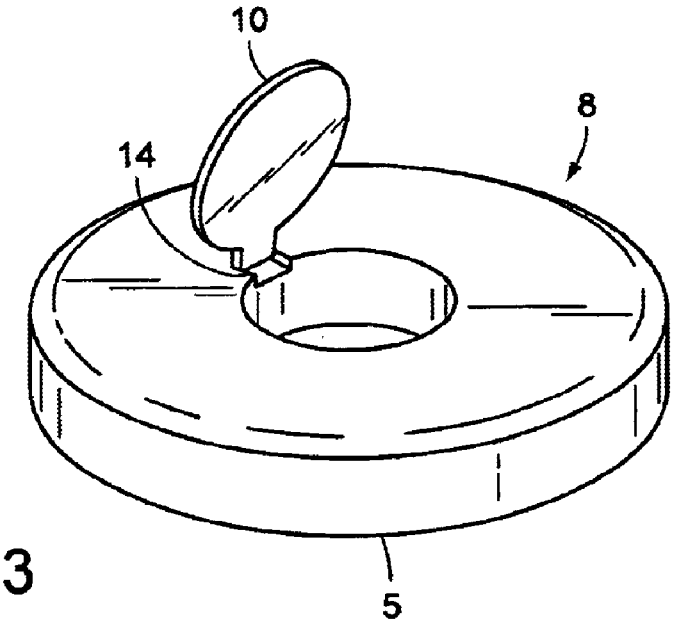
FIG. 3 shows a perspective view of a permanent cap with a hinged lid, with the hinged lid being open.

FIG. 3 shows a perspective view of a permanent cap 8 with a hinged lid 10, with the hinged lid 10 being open. Hinged lid 10 would automatically open when the brass lawn sprinkler head would raise up to begin sprinkling water onto a lawn. When the brass lawn sprinkler head would stop dispensing water onto a lawn and go back within its casing, hinged lid 10 would automatically shut due to the spring-activated lever 14 maintaining pressure on hinged lid 10.

What I claim as my invention is:

1. A cap for lawn sprinkler heads comprising:

(a) a disc having two sides, a top side and a bottom side, the disc also having a perimeter, (b) a continuous side edge attached to the bottom side of the disc around the perimeter of the disc, (c) wherein the bottom side of the disc would be placed over a lawn sprinkler head on a lawn, (d) a hinged lid incorporated into the middle of the disc, the hinged lid being pivotally attached to the disc, and (e) means for keeping the hinged lid in a downward position until pushed up by a rising sprinkler head.

2. A cap for lawn sprinkler heads according to claim 1 wherein the means for keeping the hinged lid in a downward position until pushed up by a rising sprinkler head further comprises a spring-activated lever, wherein the spring-activated lever constantly exerts a steady downward force upon the hinged lid until a rising sprinkler head pushes upward on the hinged lid.

* * * * *